US012768176B2

(12) United States Patent
Boucké

(10) Patent No.: US 12,768,176 B2
(45) Date of Patent: Oct. 20, 2026

(54) PANEL SUITABLE AS A FLOOR, CEILING OR WALL COVERING, AND COVERING FOR A FLOOR, CEILING OR WALL, WHICH IS CONSTITUTED BY A MULTITUDE OF SUCH PANELS

(71) Applicant: i4F Licensing NV, Turnhout (BE)

(72) Inventor: Eddy Alberic Boucké, Turnhout (BE)

(73) Assignee: i4F Licensing NV, Turnhout (BE)

( * ) Notice: Subject to any disclaimer, the term of this patent is extended or adjusted under 35 U.S.C. 154(b) by 0 days.

(21) Appl. No.: 19/243,176

(22) Filed: Jun. 19, 2025

(65) Prior Publication Data

US 2025/0314077 A1 Oct. 9, 2025

Related U.S. Application Data

(63) Continuation of application No. 18/018,725, filed as application No. PCT/EP2021/070607 on Jul. 22, 2021, now Pat. No. 12,359,444.

(30) Foreign Application Priority Data

| | | |
|---|---|---|
| Jul. 31, 2020 | (NL) | 2026188 |
| Jul. 31, 2020 | (NL) | 2026189 |
| Sep. 28, 2020 | (NL) | 2026559 |

(51) Int. Cl.
*E04C 3/00* (2006.01)
*E04F 15/02* (2006.01)

(52) U.S. Cl.
CPC ..... *E04F 15/02038* (2013.01); *E04F 2201/0146* (2013.01)

(58) Field of Classification Search
CPC ..... E04F 15/02038; E04F 2201/0146; E04F 15/105
See application file for complete search history.

(56) References Cited

U.S. PATENT DOCUMENTS 3,347,048 A * 10/1967 Brown ..... E02B 3/14 52/592.4
4,037,377 A * 7/1977 Howell ..... E04C 2/296 52/592.1

(Continued)

FOREIGN PATENT DOCUMENTS

| | | | |
|---|---|---|---|
| CN | 102182293 | A | 9/2011 |
| EP | 3597836 | A1 | 1/2020 |
| WO | 2018215550 | A1 | 11/2018 |

*Primary Examiner* — Basil S Katcheves
(74) *Attorney, Agent, or Firm* — The Webb Law Firm

(57) ABSTRACT

Provided is a panel suitable as a floor, ceiling or wall panel, which panel has a planar design having an upper side, a bottom side and side edges which include a first side edge provided with a first profile and a second side edge provided with a second profile. The first and second profiles are interacting profiles that can be coupled to each other, so that a first panel can be coupled in one common plane to a second, identical panel by the interacting profiles. The first and second profiles in coupled condition establish an interlocking with each other both in a horizontal and a vertical direction. The first and second profiles are configured to allow for coupling of the interacting profiles of the first panel with the second panel by a downward insertion of the interacting profile of the second panel into the interacting profile of the first panel.

22 Claims, 3 Drawing Sheets

(56) References Cited

U.S. PATENT DOCUMENTS

| | | | | |
|---|---|---|---|---|
| 6,647,690 | B1 * | 11/2003 | Martensson | E04F 15/04 52/489.1 |
| 7,484,337 | B2 * | 2/2009 | Hecht | E04F 15/181 52/592.1 |
| 9,574,354 | B2 | 2/2017 | Stevens, Jr. | |
| 9,938,727 | B2 * | 4/2018 | Ceysson | E04F 15/02038 |
| 10,337,191 | B2 * | 7/2019 | Cappelle | E04F 15/107 |
| 10,422,131 | B2 | 9/2019 | Imbeau et al. | |
| 10,619,358 | B2 * | 4/2020 | Segaert | E04F 15/105 |
| 11,242,687 | B2 | 2/2022 | Bouckéet al. | |
| 12,359,444 | B2 * | 7/2025 | Boucké | E04F 15/02038 |
| 2005/0028474 | A1 * | 2/2005 | Kim | E04F 15/04 52/578 |
| 2006/0236642 | A1 | 10/2006 | Pervan | |
| 2008/0104921 | A1 | 5/2008 | Pervan et al. | |
| 2008/0311355 | A1 | 12/2008 | Chen et al. | |
| 2009/0133353 | A1 | 5/2009 | Pervan et al. | |
| 2009/0217615 | A1 | 9/2009 | Engstrom | |
| 2009/0249733 | A1 | 10/2009 | Moebus | |
| 2011/0094178 | A1 | 4/2011 | Braun | |
| 2013/0247502 | A1 | 9/2013 | Zhang | |
| 2013/0309441 | A1 * | 11/2013 | Hannig | F16B 5/008 29/428 |
| 2014/0325930 | A1 | 11/2014 | Schneider | |
| 2019/0211569 | A1 * | 7/2019 | Boo | E04F 15/105 |
| 2023/0358056 | A1 * | 11/2023 | Boucké | E04F 15/02038 |

* cited by examiner

PANEL SUITABLE AS A FLOOR, CEILING OR WALL COVERING, AND COVERING FOR A FLOOR, CEILING OR WALL, WHICH IS CONSTITUTED BY A MULTITUDE OF SUCH PANELS

CROSS-REFERENCE TO RELATED APPLICATIONS

This application is continuation of U.S. patent application Ser. No. 18/018,725 filed Jul. 22, 2021, which is the national phase of International Patent Application No. PCT/EP2021/070607 filed Jul. 22, 2021, and claims priority to The Netherlands Patent Application Nos. 2026188 filed Jul. 31, 2020, 2026189 filed Jul. 31, 2020, and 2026559 filed Sep. 28, 2020, the disclosures of which are hereby incorporated by reference in their entireties.

BACKGROUND OF THE INVENTION

Field of the Invention

The present invention relates in a first aspect to a panel suitable as a floor, ceiling or wall panel and to compose a floor, ceiling, or wall covering. In a second aspect, the invention relates to a covering for a floor, ceiling or wall, which is constituted by a multitude of such panels that are coupled to each other.

Description of Related Art

The invention is directed to a further improvement of known panels provided with drop-down coupling profiles, such as for example disclosed in US2019/0211569, CN102182293, EP3597836, and WO2018/215550. More in particular these panels have at two opposed panels edges a first profile and a second profile, wherein the first profile and the second profile are interacting profiles that can be coupled to each other, so that a first panel can be coupled in one common plane to a second, identical panel by the interacting profiles, wherein the first profile and the second profile in coupled condition establish an interlocking with each other both in a horizontal direction and in a vertical direction, wherein the first profile and the second profile are configured to allow for a coupling of the interacting profiles of the first panel with the second panel by a vertical (drop-down) insertion of the interacting profile of the first panel into the interacting profile of the second panel.

and wherein the first profile comprises an upward tongue, and the second profile comprises a downward tongue, the respective tongues being configured to interlock with each other in coupled condition by respective interlocking surface areas, wherein the interlocking surface area of the upward tongue is inclined upwards and towards the first side edge in a vertical plane perpendicular to the respective side edge, and the interlocking surface area of the downward tongue is inclined upwards and away from the second side edge in a vertical plane perpendicular to the respective side edge.

Despite the advantages of the panel described in the prior art, it has been found that in practice the panel suffers from several drawbacks. Firstly, during the coupling of two panels a relatively forceful vertical insertion of the interacting profiles is required. This required force of insertion is not only cumbersome for the user, but also bears the risk of damage of one profile, or even of both profiles.

In order to mitigate the required force for coupling, one could consider to apply very small inclination angles for the interlocking areas, of about 1 or 2 degrees. However, such a small inclination angle would compromise the vertical interlocking of the profiles to such an extent that the interlocking is inadequate for its intended use, and in practice does not fulfil the required interlocking strength that is pursued.

In view of this drawback, it has been proposed to provide both profiles with additional interlocking features, which are located separate from the interlocking surface areas. For instance, it is proposed to locate one interlocking feature at the frontal end of an upward tongue, such that it interacts with another interlocking feature of an opposed profile that is coupled to the upward tongue.

Such additional features however lead to a more intricate design of the panel, and in particular requires a more complex way of producing such a panel so that the production costs are raised considerably.

SUMMARY OF THE INVENTION

In the above given context, it is an objective of the present invention to provide a panel of the aforementioned type, wherein one or more of the above described drawbacks are eliminated or substantially reduced.

In order to accomplish the above objective, the invention provides a, preferably planar, panel of the aforementioned type, which panel has an upper side, a bottom side and side edges which comprise a first side edge provided with a first profile and a second side edge provided with a second profile, wherein the first profile and the second profile are interacting profiles that can be coupled to each other, so that a first panel can be coupled in one common plane to a second, identical panel by the interacting profiles, wherein the first profile and the second profile in coupled condition establish an interlocking with each other both in a horizontal direction and in a vertical direction, wherein the first profile and the second profile are configured to allow for a coupling of the interacting profiles of the first panel with the second panel by a downward insertion of the interacting profile of the second panel into the interacting profile of the first panel, and wherein the first profile comprises an upward tongue, and the second profile comprises a downward tongue, the respective tongues being configured to interlock with each other in coupled condition by respective interlocking surface areas, wherein the interlocking surface area of the upward tongue is at least partially, preferably entirely, inclined upwardly towards the first side edge, and the interlocking surface area of the downward tongue is inclined upwardly away from the second side edge, wherein the interlocking surface areas of at least one of, and preferably both, the upward tongue and the downward tongue, each comprise a section which is vertically divided in a plurality of area sections comprising an upper area section and at least one lower area section that are adjacent to each other, which section comprises a crease between the upper area section and the lower area section, and wherein proximal to the crease, the upper area section and the lower area section are each inclined differently under an inclination angle which is measured relative to an upward vertical vector of the panel, and in a vertical plane perpendicular to the respective side edge, such that the inclination angle of the upper area section is smaller than the inclination angle of the lower area section. Preferably, at the first coupling profile, both inclination angles of the lower area section and the upper area section are leaning upwardly towards the first edge and/or towards a core (main body) of the panel. Preferably, at the second coupling profile, both inclination angles of the lower area section and the upper area section are leaning downwardly towards the second edge and/or towards said core (main body) of the panel. An angle enclosed by each inclination angle and the upward vertical vector deviates from 0 degrees. Hence, each lower area section and each upper area section extends in a direction which deviates from the vertical direction in which the upward vertical vector extends.

Said upward vertical vector may also be referred to as the normal vector, or the normal, in upward direction and which is perpendicular to a plane defined by the panel. It is imaginable that said section of an interlocking surface area comprises an upper area section (upper segment) and a plurality of lower area sections (lower segments), wherein each area section is connected to at least one other area section by means of a crease. This means that a plurality of creases may be applied. The plurality of lower area sections are typically positioned on top of each other, wherein each lower area section may have its own inclination with respect to the vertical vector of the panel. It is imaginable that at least one crease formed in between two lower area sections (e.g. a first lower area section and a second lower area section) constitutes an inflection point or inflection zone (as seen from a cross-sectional view of a panel), wherein the inclination of these two lower area sections changes of sign (e.g. from minus to plus or vice versa) and/or changes of direction with respect to the vertical vector of the plane.

The panel according to the invention comprises interlocking surface areas which are (vertically) divided in an upper area section and lower area section(s) having different inclination angles, and comprise a crease between the upper area section and the lower area section(s), and—if applied—between two adjoining lower area sections. Due to these characterizing features of the panel, two such panels can be coupled with the following advantageous effects:

a) the coupling of the mutually interacting profiles of two panels by vertical insertion can be executed more smoothly, as the upper area section of the upward tongue allows to apply a relatively small inclination angle, so that during the first stage of vertical insertion a relatively small and constant degree of deformation of the interacting profiles is required;

b) despite the relatively small inclination angle of the upper area section, an adequate vertical locking of the two panels in coupled condition is still attained by having a relatively large inclination angle for the lower area sections of the downward tongue and the upward tongue;

c) the vertical locking by the lower area sections is further strengthened by the presence of the respective creases, which intrinsically have a cornered structure and as such form an additional obstacle which has to be overcome in order to achieve a vertical unlocking of two coupled profiles.

It is additionally noted that the production costs of the panel according to the invention are attractive, because the interlocking surface areas of the respective profiles according to the invention can be produced relatively easily, for instance by milling of the profiles.

Furthermore, the production of the panel allows for a simplification over the prior art, by the fact that the panel does not necessarily require additional interlocking features that are applied in the prior art. For instance, an interlocking feature at the frontal end of an upward tongue, and a horizontally opposed interlocking feature of an opposed profile can be dispensed with.

Preferably in the panel according to the invention, the first and second profile are essentially complementary (form-fittingly) profiles. Such profiles offer a high degree of adequate interlocking in horizontal and vertical direction, as well as a tight sealing between two coupled panels, especially at their upper side.

Further preferably in the panel according to the invention, the interlocking surface areas of the downward tongue and the upward tongue are configured to be facing each other, more preferably in abutting contact, when the first and second panel are in coupled condition.

Especially preferred is that in a coupled condition, the respective upper area sections, the lower area sections and the creases are configured to be facing each other, more preferably in abutting contact.

In particular it is preferred in the panel according to the invention, that the respective creases extend linearly in the longitudinal direction of the respective side edges on which the creases are provided, and preferably extend in a horizontal plane of the panel. As such, the opposed creases of two coupled profiles together form a linear obstacle which has a high efficacy to block any vertical uncoupling of coupled profiles. Each crease may also be considered as a slope discontinuity or as a kink of buckle. In view of the present invention a continuously curved surface is not considered as an (in)finite number of adjacent areas comprising a crease in between.

It is further preferred in the panel according to the invention, that the inclination angle of the upper area section of the interlocking surface area of the upward tongue is in the range of 1 to 5 degrees, preferably 1 to 3 degrees, and is similar or equal to the inclination angle of the upper area section of the interlocking surface area of the downward tongue.

Such an inclination angle of the upper area section is particularly effective in achieving that the coupling of two panels by vertical insertion of two interacting profiles can be executed relatively smoothly and with a controlled amount of force, because during the first stage of vertical insertion a relatively small and constant degree of deformation of the interacting profiles is required.

It is also preferred in the panel according to the invention, that the inclination angle of the lower area section of the interlocking surface area of the upward tongue is in the range of 5 to 20 degrees, preferably 5 to 10 degrees, and is similar or equal to the inclination angle of the lower area section of the interlocking surface area of the downward tongue.

Such an inclination angle has proven sufficient to achieve an adequate vertical locking of the two panels in coupled condition.

In the panel according to the invention, it is further preferred that the crease defines a cornered structure between the upper area section and lower area section, which cornered structure when viewed in a vertical plane perpendicular to the respective side edge, has an obtuse angle in the range of 179 to 160 degrees, preferably 178 to 171 degrees, most preferably 177 to 172 degrees. Typically such a cornered structure has a restricted height. Preferably, the height of such a cornered structure is less than 0.5 mm, preferably less than 0.3 mm, more preferably less than 0.2 mm.

It has been found that such an obtuse angle is sufficient to strengthen the vertical interlocking of two profiles, while still allowing the profiles to be coupled by vertical insertion in a relatively smooth manner.

Preferably, in the panel according to the invention, the upper area sections and the lower area sections are essentially flat sections. The application of such flat sections was proven to be effective in attaining the advantageous effects of the invention.

Further preferably in the panel according to the invention, the upward and downward tongue each have a rounded surface area above the upper area section, and a rounded surface area below the lower area section. The rounded sections serve to reduce friction forces between the surfaces of the profiles when these are sliding over each other during the process of coupling by vertical insertion. The rounded sections further assist in guiding the profiles towards a correct alignment for vertical insertion.

According to a preferred embodiment of the panel according to the invention, at least one of the interlocking surface areas of the downward tongue and the upward tongue, is provided with a malleable coating, in particular a wax coating.

The malleable coating further serves to reduce friction forces between the surfaces of the profiles when these are sliding over each other during the process of coupling by vertical insertion.

In particular it is preferred that the lower area section of the downward tongue and/or the upper area section of the upward tongue, is provided with a malleable coating, in particular a wax coating. As these sections experience the most friction forces during coupling by vertical insertion, the malleable coating is thus most effective when applied in this way.

Furthermore in this context, it is preferred that the crease is virtually free from a malleable coating. As the crease has the function of blocking an uncoupling movement, it is thus advantageous when the crease is not provided with friction-reducing features such as a malleable coating.

It is advantageous in the panel according to the invention, that a frontal side of the downward tongue of the second profile and a horizontally opposed side of the first profile comprise respective upper contact surfaces which extend substantially vertically towards the upper side of the panel, and are configured to be in abutting contact when the first and second profile are in coupled condition.

In coupled condition of the two profiles, such upper contact surfaces cooperate with the interlocking surface areas, in order to establish a vertical and horizontal locking between the panels without play.

In the panel according to the invention it is further preferably featured that a frontal side of the downward tongue of the second profile is provided with an upper protrusion, and a horizontally opposed side of the first profile is provided with an upper recess, which protrusion and recess are substantially complementary, such that in a coupled condition of the two profiles, the protrusion of the second profile interlocks with the recess of the first profile.

Such an interacting protrusion and recess further enhances the vertical interlocking of two coupled panels. In addition, the upper protrusion and upper recess contribute to forming a tight sealing at the upper side of the two coupled panels.

Especially preferred in this context is that the upper protrusion and upper recess are provided at a vertically higher position than the creases of the respective profiles.

Furthermore, it is preferred that the surfaces of the upper protrusion and the upper recess are composed of essentially flat surfaces.

With regard to the interacting profiles of the panel according to the invention, it is particularly preferred that:

- the upward tongue is connected to the first side edge by a lower bridge part extending parallel to the plane of the panel at the bottom side of the panel, and wherein the lower bridge part delimits a downward groove which is enclosed between the upward tongue and the first side edge; and
- the downward tongue is connected to the second side edge by an upper bridge part extending parallel to the plane of the panel at a top side of the panel, and wherein the upper bridge part delimits an upward groove which is enclosed between the downward tongue and the second side edge;

further wherein the downward groove and the upward groove are configured to receive respectively the downward tongue and the upward tongue in a coupled condition of the two interacting profiles.

With further preference, in the coupled condition of the first and second profile, at least one interstitial space is present between the downward tongue and the downward groove, and at least one interstitial space is present between the upward tongue and the upward groove.

Such interstitial spaces act as dust chambers in which particular matter such as dirt or debris is collected during coupling of the panels, in order to avoid the particular matter to affect the quality of the coupling of the two profiles. Furthermore, the interstitial spaces allow the coupled panels to expand to a certain degree under varying climate conditions.

In the panel according to the invention, it is further preferred that an interstitial space is present between a frontal side of the upward tongue of the first profile and a horizontally opposed side of the second profile.

Such an interstitial space allows the coupled panels to expand in particular in a horizontal direction under varying climate conditions.

In a further preferred embodiment of the panel according to the invention, a frontal side of the upward tongue of the first profile is provided with a lower protrusion, and a horizontally opposed side of the second profile is provided with a lower recess, wherein the protrusion and the recess are substantially complementary, such that in a coupled condition of two interacting profiles, the protrusion of the first profile and the recess of the second profile interlock with each other.

The addition of such a lower protrusion and a lower recess further enhance the vertical interlocking of the profiles.

The panels according to the invention are for example at least partially made from magnesium oxide, or are magnesium oxide based. The panel according to the invention may comprise: a core provided with an upper side and a lower side, a decorative top structure (or top section) affixed, either directly or indirectly on said upper side of the core, wherein said core comprises: at least one composite layer comprising: at least one magnesium oxide (magnesia) and/or magnesium hydroxide based composition, in particular a magnesia cement. Particles, in particular cellulose and/or silicone based particles, may be dispersed in said magnesia cement. Optionally one or more reinforcement layers, such as glass fibre layers, may embedded in said composite layer. The core composition may also comprise magnesium chloride leading to a magnesium oxychloride (MOC) cement, and/or magnesium sulphate leading to magnesium oxysulphate (MOS) cement.

It has been found that the application of a magnesium oxide and/or magnesium hydroxide based composition, and in particular a magnesia cement, including MOS and MOC, significantly improves the inflammability (incombustibility) of the decorative panel as such. Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. Moreover, magnesia cement is a relatively good insulating material, both thermally and electrically, which makes the panel in particularly suitable for flooring for radar stations and hospital operating rooms. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner. Moreover, an additional advantage of the decorative panel is that it is suitable both for indoor and outdoor use.

As already addressed, the magnesia cement is based upon magnesium oxide and/or magnesium hydroxide. The magnesia cement as such may be free of magnesium oxide, dependent on the further reactants used to produce the magnesia cement. Here, it is, for example, well imaginable that magnesia as reactant is converted into magnesium hydroxide during the production process of the magnesia cement. Hence, the magnesia cement as such may comprise magnesium hydroxide. Typically, the magnesia cement comprises water, in particular hydrated water. Water is used as normally binder to create a strong and coherent cement matrix.

The magnesia based composition, in particular the magnesia cement, may comprise magnesium chloride ($MgCl_2$). Typically, when magnesia (MgO) is mixed with magnesium chloride in an aqueous solution, a magnesia cement will be formed which comprises magnesium oxychloride (MOC). The bonding phases are $Mg(OH)_2$, $5Mg(OH)_2 \cdot MgCl_2 \cdot 8H_2O$ (5-form), $3Mg(OH)_2 \cdot MgCl_2.8H_2O$ (3-form), and $Mg_2(OH)ClCO_3 \cdot 3H_2O$. The 5-form is the preferred phase, since this phase has superior mechanical properties. Related to other cement types, like Portland cement, MOC has superior properties. MOC does not need wet curing, has high fire resistance, low thermal conductivity, good resistance to abrasion. MOC cement can be used with different aggregates (additives) and fibres with good adherence resistance. It also can receive different kinds of surface treatments. MOC develops high compressive strength within 48 hours (e.g. 8,000-10,000 psi). Compressive strength gain occurs early during curing—48-hour strength will be at least 80% of ultimate strength. The compressive strength of MOC is preferably situated in between 40 and 100 N/mm2. The flexural tensile strength is preferably 10-17 $N/mm^2$. The surface hardness of MOC is preferably 50-250 $N/mm^2$. The E-Modulus is preferably 1-3 $10^4$ $N/mm^2$. Flexural strength of MOC is relatively low but can be significantly improved by the addition of fibres, in particular cellulose based fibres. MOC is compatible with a wide variety of plastic fibres, mineral fibres (such as basalt fibres) and organic fibres such as bagasse, wood fibres, and hemp. MOC used in the panel according to the invention may be enriched by one or more of these fibre types. MOC is non-shrinking, abrasion and acceptably wear resistant, impact, indentation and scratch resistant. MOC is resistible to heat and freeze-thaw cycles and does not require air entrainment to improve durability. MOC has, moreover, excellent thermal conductivity, low electrical conductivity, and excellent bonding to a variety of substrates and additives, and has acceptable fire resistance properties. MOC is less preferred in case the panel is to be exposed to relatively extreme weather conditions (temperature and humidity), which affect both setting properties but also the magnesium oxychloride phase development.

Over a period of time, atmospheric carbon dioxide will react with magnesium oxychloride to form a surface layer of $Mg_2(OH)ClCO_3 \cdot 3H_2O$. This layer serves to slow the leaching process. Eventually additional leaching results in the formation of hydromagnesite, $4MgO \cdot 3CO_3 \cdot 4H_2O$, which is insoluble and enables the cement to maintain structural integrity.

The magnesium based composition, and in particular the magnesia cement, may be based upon magnesium sulphate, in particular heptahydrate sulphate mineral epsomite ($MgSO_4 \cdot 7H_2O$). This latter salt is also known as Epsom salt. In aqueous solution MgO reacts with MgSO4, which leads to magnesium oxysulfate cement (MOS), which has very good binding properties. In MOS, $5Mg(OH)2 \cdot MgSO4.8H_2O$ is the most commonly found chemical phase. Although MOS is not as strong as MOC, MOS is better suited for fire resistive uses, since MOS start to decompose at temperatures more than two times higher than MOC giving longer fire protection. Moreover, their products of decomposition at elevated temperatures are less noxious (sulfur dioxide) than those of oxychloride (hydrochloric acid) and, in addition, less corrosive. Furthermore, weather conditions (humidity, temperature, and wind) during application are not as critical with MOS as with MOC. The mechanical strength of MOS cement depends mainly on the type and relative content of the crystal phases in the cement. It has been found that four basic magnesium salts that can contribute to the mechanical strength of MOS cement exist in the ternary system $MgO—MgSO_4—H_2O$ at different temperatures between of 30 and 120 degrees Celsius $5Mg(OH)_2 \cdot MgSO_4 \cdot 3H_2O$ (513 phase), $3Mg(OH)_2 \cdot MgSO_4 \cdot 8H_2O$ (318 phase), $Mg(OH)_2 \cdot 2MgSO_4 \cdot 3H_2O$ (123 phase), and $Mg(OH)_2 \cdot MgSO_4 \cdot 5H_2O$ (115 phase). Normally, the 513 phase and 318 phase could only be obtained by curing cement under saturated steam condition when the molar ratio of MgO and MgSO4 was fixed at (approximately) 5:1. It has been found that the 318 phase is significantly contributing to the mechanical strength and is stable at room temperature, and is therefore preferred to be present in the MOS applied. This also applies to the 513 phase. The 513 phase typically has a (micro)structure comprising a needle-like structure. This can be verified by means of SEM analysis. The magnesium oxysulfate ($5Mg(OH)2 \cdot MgSO4 \cdot 3H_2O$) needles may be formed substantially uniform, and will typically have a length of 10-15 μm and a diameter of 0.4-1.0 μm. When it is referred to a needle-like structure, also a flaky-structure and/or a whisker-structure can be meant. In practice, it does not seem feasible to obtain MOS comprising more than 50% 513 or 318 phase, but by adjusting the crystal phase composition can be applied to improve the mechanical strength of MOS. Preferably, the magnesia cement comprises at least 10%, preferably at least 20% and more preferably at least 30% of the $5Mg(OH)_2 \cdot MgSO_4 \cdot 3H_2O$ (513-phase). This preferred embodiment will provide a magnesia cement having sufficient mechanical strength for use in the core layer of a floor panel.

The crystal phase of MOS is adjustable by modifying the MOS by using an organic acid, preferably citric acid and/or by phosphoric acid and/or phosphates. During this modification new MOS phases can obtained, which can be expressed by 5Mg (OH) 2·MgSO4.5H2O (515 phase) and $Mg(OH)_2 \cdot MgSO_4 \cdot 7H_2O$ (517-phase). The 515 phase is obtainable by modification of the MOS by using citric acid. The 517 phase is obtainable by modification of the MOS by using phosphoric acid and/or phosphates ($H_3PO_4$, $KH_2PO_4$, $K_3PO_4$ and $K_2HPO_4$). These 515 phase and 517 phase can be determined by chemical element analysis, wherein SEM analysis proves that the microstructure both of the 515 phase and the 517 phase is a needle-like crystal, being insoluble in water. In particular, the compressive strength and water resistance of MOS can be improved by the additions of citric acid. Hence, it is preferred that MOS, if applied in the panel according to the invention, comprises 5Mg (OH) 2·MgSO4.5H2O (515 phase) and/or $Mg(OH)_2 \cdot MgSO_4 \cdot 7H_2O$ (517-phase). As addressed above, adding phosphoric acid and phosphates can extend the setting time and improve the compressive strength and water resistance of MOS cement by changing the hydration process of MgO and the phase composition. Here, phosphoric acid or phosphates ionize in solution to form $H_2PO_4^-$, $HPO_4^{2-}$, and/or $PO_4^{3-}$, wherein these anions adsorb onto $[Mg(OH)(H_2O)^x]^+$ to inhibit the formation of $Mg(OH)_2$ and further promote the generation of a new magnesium sub-sulfate phase, leading to the compact structure, high mechanical strength and good water resistance of MOS cement. The improvement produced by adding phosphoric acid or phosphates to MOS cement follows the order of $H_3PO_4 = KH_2PO+ >> K_2HPO_4 >> K_3PO_4$. MOS has better volumetric stability, less shrinkage, better binding properties and lower corrosivity under a significantly wider range of weather conditions than MOC, and could therefore be preferred over MOS. The density of MOS typically varies from 350 to 650 kg/m3. The flexural tensile strength is preferably 1-7 N/mm2.

The magnesium cement composition preferably comprises one or more silicone based additives. Various silicone based additives can be used, including, but not limited to, silicone oils, neutral cure silicones, silanols, silanol fluids, silicone (micro)spheres or silicone particles, and mixtures and derivatives thereof. Silicone oils include liquid polymerized siloxanes with organic side chains, including, but not limited to, poly(methyl)siloxane and derivatives thereof. Neutral cure silicones include silicones that release alcohol or other volatile organic compounds (VOCs) as they cure. Other silicone based additives and/or siloxanes (e.g., siloxane polymers) can also be used, including, but not limited to, hydroxyl (or hydroxy) terminated siloxanes and/or siloxanes terminated with other reactive groups, acrylic siloxanes, urethane siloxanes, epoxy siloxanes, and mixtures and derivatives thereof. As detailed below, one or more crosslinkers (e.g., silicone based crosslinkers) can also be used. The viscosity of the one or more silicone based additives (e.g., silicone oil, neutral cure silicone, silanol fluid, siloxane polymers, etc.) may be about 100 cSt (at 25° C.), which is called low-viscous. In alternative embodiments, the viscosity of the one or more silicone based additives (e.g., silicone oil, neutral cure silicone, silanol fluid, siloxane polymers, etc.) is between about 20 cSt (25° C.) and about 2000 cSt (25° C.). In other embodiments, the viscosity of the one or more silicone based additives (e.g., silicone oil, neutral cure silicone, silanol fluid, siloxane polymers, etc.) is between about 100 cSt (25° C.) and about 1250 cSt (25° C.). In other embodiments, the viscosity of the one or more silicone based additives (e.g., silicone oil, neutral cure silicone, silanol fluid, siloxane polymers, etc.) is between about 250 cSt (25° C.) and 1000 cSt (25° C.). In yet other embodiments, the viscosity of the one or more silicone based additives (e.g., silicone oil, neutral cure silicone, silanol fluid, siloxane polymers, etc.) is between about 400 cSt (25° C.) and 800 cSt (25° C.). And in particular embodiments, the viscosity of the one or more silicone based additives (e.g., silicone oil, neutral cure silicone, silanol fluid, siloxane polymers, etc.) is between about 800 cSt (25° C.) and about 1250 cSt (25° C.). One or more silicone based additives having higher and/or lower viscosities can also be used. For example, in further embodiments, the viscosity of the one or more silicone based additives (e.g., silicone oil, neutral cure silicone, silanol fluid, siloxane polymers, etc.) is between about 20 cSt (25° C.) and about 200,000 (25° C.) cSt, between about 1,000 cSt (25° C.) and about 100,000 cSt (25° C.), or between about 80,000 cSt (25° C.) and about 150,000 cSt (25° C.). In other embodiments, the viscosity of the one or more silicone based additives (e.g., silicone oil, neutral cure silicone, silanol fluid, siloxane polymers, etc.) is between about 1,000 cSt (25° C.) and about 20,000 cSt (25° C.), between about 1,000 cSt (25° C.) and about 10,000 cSt (25° C.), between about 1,000 cSt (25° C.) and about 2,000 cSt (25° C.), or between about 10,000 cSt (25° C.) and about 20,000 cSt (25° C.). In yet other embodiments, the viscosity of the one or more silicone based additives (e.g., silicone oil, neutral cure silicone, silanol fluid, siloxane polymers, etc.) is between about 1,000 cSt (25° C.) and about 80,000 cSt (25° C.), between about 50,000 cSt (25° C.) and about 100,000 cSt (25° C.), or between about 80,000 cSt (25° C.) and about 200,000 cSt (25° C.). And in still further embodiments, the viscosity of the one or more silicone based additives (e.g., silicone oil, neutral cure silicone, silanol fluid, siloxane polymers, etc.) is between about 20 cSt (25° C.) and about 100 cSt (25° C.). Other viscosities can also be used as desired.

In a preferred embodiment, the magnesium cement composition, in particular the magnesium oxychloride cement composition, comprises a single type of silicone based additive. In other embodiments, a mixture of two or more types of silicone based additives are used. For example, in some embodiments, the magnesium oxychloride cement composition can include a mixture of one or more silicone oils and neutral cure silicones. In particular embodiments, the ratio of silicone oil to neutral cure silicone can be between about 1:5 and about 5:1, by weight. In other such embodiments, the ratio of silicone oil to neutral cure silicone can be between about 1:4 and about 4:1, by weight. In other such embodiments, the ratio of silicone oil to neutral cure silicone can be between about 1:3 and about 3:1, by weight. In yet other such embodiments, the ratio of silicone oil to neutral cure silicone can be between about 1:2 and about 2:1, by weight. In further such embodiments, the ratio of silicone oil to neutral cure silicone can be about 1:1, by weight.

It is imaginable that one or more crosslinkers are used in the magnesia cement. In some embodiments, the crosslinkers are silicone based crosslinkers. Exemplary crosslinkers include, but are not limited to, methyllrime hoxysilane, methyltrie hoxysilane, methyltris (methylethylketoximino)silane and mixtures and derivatives thereof. Other crosslinkers (including other silicone based crosslinkers) can also be used. In some embodiments, the magnesium oxychloride cement composition comprises one or more silicone based additives (e.g., one or more silanols and/or silanol fluids) and one or more crosslinkers. The ratio of one or more silicone based additives (e.g., silanols and/or silanol fluids) to crosslinker can be between about 1:20 and about 20:1, by weight, between about 1:10 and about 10:1 by weight, or between about 1:1 and about 10:1, by weight.

The magnesium (oxychloride) cement compositions comprising one or more silicone based additives may exhibit reduced sensitivity to water as compared to traditional magnesium (oxychloride) cement compositions. Further, in some embodiments, the magnesium (oxychloride) cement compositions comprising one or more silicone based additives may exhibit little or no sensitivity to water. The magnesium (oxychloride) cement compositions comprising one or more silicone based additives can further exhibit hydrophobic and water resistant properties.

Also, the magnesium (oxychloride) cement compositions comprising one or more silicone based additives can exhibit improved curing characteristics. For example, magnesium (oxychloride) cement compositions cure to form various reaction products, including $3Mg(OH)_2 \cdot MgCl_2 \cdot 8H2O$ (phase 3) and $5Mg(OH)_2 \cdot MgCl_2 \cdot 8H_2O$ (phase 5) crystalline structures. In some situations, higher percentages of the $5Mg(OH)2 \cdot MgCl_2 \cdot 8H_2O$ (phase 5) crystalline structure is preferred. In such situations, the addition of one or more silicone based additives to the magnesium oxychloride cement compositions can stabilize the curing process which can increase the percentage yield of $5Mg(OH)_2 \cdot MgCl_2 \cdot 8H2O$ (phase 5) crystalline structures. For example, in some embodiments, the magnesium oxychloride compositions comprising one or more silicone based additives can cure to form greater than 80% $5Mg(OH)_2 \cdot MgCl_2 \cdot 8H_2O$ (phase 5) crystalline structures. In other embodiments, the magnesium oxychloride compositions comprising one or more silicone based additives can cure to form greater than 85% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 90% $5Mg(OH)2 \cdot MgCl2.8H2O$ (phase 5) crystalline structures. In yet other embodiments, the magnesium oxychloride compositions comprising one or more silicone based additives can cure to form greater than 95% $5Mg(OH)_2 \cdot MgCl_2.8H_2O$ (phase 5) crystalline structures. In yet other embodiments, the magnesium oxychloride compositions comprising one or more silicone based additives can cure to form greater than 98% $5Mg(OH)_2 \cdot MgCl_2.8H_2O$ (phase 5) crystalline structures. In yet other embodiments, the magnesium oxychloride compositions comprising one or more silicone based additives can cure to form about 100% $5Mg(OH)_2 \cdot MgCl_2 \cdot 8H_2O$ (phase 5) crystalline structures.

Furthermore, the magnesium (oxychloride) cement compositions comprising one or more silicone based additives can also exhibit increased strength and bonding characteristics. If desired, the magnesium (oxychloride) cement compositions comprising one or more silicone based additives can also be used to manufacture magnesium (oxychloride) cement or concrete structures that are relatively thin. For example, the magnesium (oxychloride) cement compositions comprising one or more silicone based additives can be used to manufacture cement or concrete structures or layers having thicknesses of less than 8 mm, preferably less than 6 mm.

For realizing the coupling between the coupling part, temporary deformation of the coupling part(s) may be desired and/or even required, as a result of which it is beneficial to mix magnesium oxide and/or magnesium hydroxide and/or magnesium chloride and/or magnesium sulphate with one or more silicone based additives, since this leads to an increased a degree of flexibility and/or elasticity. For example, in some embodiments, cement and concrete structures formed using the magnesium oxychloride cement compositions can bend or flex without cracking or breaking.

The magnesium (oxychloride) cement compositions comprising one or more silicone based additives can further comprise one or more additional additives. The additional additives can be used to enhance particular characteristics of the composition. For example, in some embodiments, the additional additives can be used to make the structures formed using the disclosed magnesium oxychloride cement compositions look like stone (e.g., granite, marble, sandstone, etc.). In particular embodiments, the additional additives can include one or more pigments or colorants. In other embodiments, the additional additives can include fibers, including, but not limited to, paper fibers, wood fibers, polymeric fibers, organic fibers, and fiberglass. The magnesium oxychloride cement compositions can also form structures that are UV stable, such that the color and/or appearance is not subject to substantial fading from UV light over time. Other additives can also be included in the composition, including, but not limited to plasticizers (e.g., polycarboxylic acid plasticizers, polycarboxylate ether-based plasticizers, etc.), surfactants, water, and mixtures and combinations thereof. As indicated above, the magnesium oxychloride cement composition, if applied, can comprise magnesium oxide (MgO), aqueous magnesium chloride ($MgCl_2$ (aq)), and one or more silicone based additives. Instead of aqueous magnesium chloride ($MgCl_2$) magnesium chloride ($MgCl_2$) powder can also be used. For example, magnesium chloride ($MgCl_2$) powder can be used in combination with an amount of water that would be equivalent or otherwise analogous to the addition of aqueous magnesium chloride ($MgCl_2$ (aq)).

In certain embodiments, the ratio of magnesium oxide (MgO) to aqueous magnesium chloride ($MgCl_2$ (aq)), if applied, in the magnesium oxychloride cement composition can vary. In some of such embodiments, the ratio of magnesium oxide (MgO) to aqueous magnesium chloride ($MgCl_2$ (aq)) is between about 0.3:1 and about 1.2:1, by weight. In other embodiments, the ratio of magnesium oxide (MgO) to aqueous magnesium chloride ($MgCl_2$ (aq)) is between about 0.4:1 and about 1.2:1, by weight. And in yet other embodiments, the ratio of magnesium oxide (MgO) to aqueous magnesium chloride ($MgCl_2$ (aq)) is between about 0.5:1 and about 1.2:1, by weight.

The aqueous magnesium chloride ($MgCl_2$ (aq)) can be described as (or otherwise derived from) a magnesium chloride brine solution. The aqueous magnesium chloride ($MgCl_2$ (aq)) (or magnesium chloride brine) can also include relatively small amounts of other compounds or substances, including but not limited to, magnesium sulphate, magnesium phosphate, hydrochloric acid, phosphoric acid, etcetera.

In a preferred embodiment the amount of the one or more (liquid) silicone based additives within the magnesium oxychloride cement composition can be defined as the ratio of silicone based additives to magnesium oxide (MgO). For example, in some embodiments, the weight ratio of silicone based additives to magnesium oxide (MgO), is between 0.06 and 0.6.

Preferably, It is also imaginable, and even favourable, to incorporate in the core layer at least one oil, such as linseed oil or silicon oil. This renders the magnesium based core layer and/or thermoplastic based core layer more flexibility and reduced risk of breakage. Instead of or in addition to oil it is also imaginable to incorporate in the core layer one or more water-soluble polymers or polycondensed (synthetic) resins, such as polycarboxylic acid. This leads to the advantage that during drying/curing/setting the panel will not shrink which prevents the formation of cracks, and moreover provides the core layer, after drying/curing/setting, a more hydrophobic character, which prevents penetration of water (moisture) during subsequent storage and use.

It is imaginable that the core layer comprises polycaprolactone (PCL). This biodegradable polymer is especially preferred as this has been found to be made to melt by the exothermic reaction of the reaction mixture. It has a melting point of ca. 60° C. The PCL may be low density or high density. The latter is especially preferred as it produces a stronger core layer. Instead of, or in addition to, other polymers may be used, preferably a polymer chosen from the group consisting of: other poly(lactic-co-glycolic acid) (PLGA), poly(lactic acid) (PLA), poly(glycolic acid) (PGA), the family of polyhydroxyalkanoates (PHA), polyethylene glycol (PEG), polypropylene glycol (PPG), polyesteramide (PEA), poly(lactic acid-co-caprolactone), poly (lactide-co-trimethylene carbonate), poly(sebacic acid-co-ricinoleic acid) and a combination thereof.

Alternatively, the panel, in particular the core layer, may at least partly be made of PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. Recycled PUR may be made based on recyclable polymers, such as based on recyclable PET. PET can be recycled chemically by using glycolysis or depolymerisation of PET into monomers or oligomers, and subsequently into polyurethane polyols in the end. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based. The core may be solid or foamed, or both in case the core is composed of a plurality of parts/layers.

It may be advantageous in case the core layer comprises porous granules, in particular porous ceramic granules. Preferably the granules have a plurality of micropores of an average diameter of from 1 micron to 10 micron, preferably from 4 to 5 micron. That is, the individual granules preferably have micropores. Preferably, the micropores are interconnecting. They are preferably not confined to the surface of the granules but are found substantially throughout the cross-section of the granules. Preferably, the size of the granules is from 200 micron to 900 micron, preferably 250 micron to 850 micron, especially 250 to 500 micron or 500 to 850 micron. Preferably, at least two different sizes of granules, most preferably two, are used. Preferably, small and/or large granules are used. The small granules may have a size range of 250 to 500 micron. Preferably the large granules have a diameter of 500 micron to 850 micron. The granules may each be substantially of the same size or of two or more predetermined sizes. Alternatively, two or more distinct size ranges may be used with a variety of different sized particles within each range. Preferably two different sizes or ranges of sizes are used. Preferably, the granules each comprise a plurality of microparticles, substantially each microparticle being partially fused to one or more adjacent microparticles to define a lattice defining the micropores. Each microparticle preferably has an average size of 1 micron to 10 micron, with an average of 4 to 5 micron. Preferably, the average size of the micropores is from 2 to 8 micron, most preferably 4 to 6 micron. The micropores may be irregular in shape. Accordingly, the size of the micropores, and indeed the midi-pores referred to below, are determined by adding the widest diameter of the pore to the narrowest diameter of the pore and dividing by 2. Preferably, the ceramic material is evenly distributed throughout a cross-section of the core layer, that is substantially without clumps of ceramic material forming. Preferably, the microparticles have an average size of at least 2 micron or 4 micron and/or less than 10 micron or less than 6 micron, most preferably 5 to 6 micron. This particle size range has been found to allow the controlled formation of the micropores.

The granules may also comprise a plurality of substantially spherical midi-pores having an average diameter of 10 to 100 micron. They substantially increase the total porosity of the ceramic material without compromising the mechanical strength of the materials. The midi-pores are preferably interconnected via a plurality of micropores. That is, the midi-pores may be in fluid connection with each other via micropores. The average porosity of the ceramic material itself is preferably at least 50%, more preferably greater than 60%, most preferably 70 to 75% average porosity. The ceramic material used to produce the granules may be any (non-toxic) ceramic known in the art, such as calcium phosphate and glass ceramics. The ceramic may be a silicate, though is preferably a calcium phosphate, especially [alpha]- or [beta]-tricalcium phosphate or hydroxyapatite, or mixtures thereof. Most preferably, the mixture is hydroxyapatite and [beta]-tricalcium phosphate, especially more than 50% w/w [beta]-tricalcium, most preferably 85% [beta]-tricalcium phosphate and 15% hydroxyapatite. Most preferably the material is 100% hydroxyapatite. Preferably the cement composition or dry premix comprises 15 to 30% by weight of granules of the total dry weight of the composition or premix.

The porous particles could lead to a lower average density of the core layer and hence to a reduction of weight which is favourable from an economic and handling point of view. Moreover, the presence of porous particles in the core layer typically leads to, at least some extent, an increased porosity of a porous top surface and bottom surface of the core layer, which is beneficial for attaching an additional layer to the top surface and/or bottom surface of the core layer, such as, for example, a primer layer, an (initially liquid) adhesive layer, or another decorative or functional layer. Often, these layers are initially applied in a liquid state, wherein the pores allow the liquid substance to be sucked up (to permeate) into the pores, which increases the contact surface area between the layers and hence improves the bonding strength between said layers.

Preferably, the panel is a decorative panel, comprising: at least one core layer, and at least one decorative top section (or top structure), directly or indirectly affixed to said core layer, wherein the top section defines a top surface of the panel, a plurality of side edges at least partially defined by said core layer and/or by side top section, comprising said first side edge provided with said first profile and said second side edge provided with said second profile.

The top section preferably comprises at least one decorative layer affixed, either directly or indirectly, to an upper surface of the core layer. The decorative layer may be a printed layer, and/or may be covered by at least one protective (top) layer covering said decorative layer. The protective layer also makes part of the decorative top section. The presence of a print layer and/or a protective layer could prevent the tile to be damaged by scratching and/or due to environmental factors such as UV/moisture and/or wear and tear. The print layer may be formed by a film onto which a decorative print is applied, wherein the film is affixed onto the substrate layer and/or an intermediate layer, such as a primer layer, situated in between the substrate layer and the decorative layer. The print layer may also be formed by at least one ink layer which is directly applied onto a top surface of the core layer, or onto a primer layer applied onto the substrate layer. The panel may comprise at least one wear layer affixed, either directly or indirectly, to an upper surface of the decorative layer. The wear layer also makes part of the decorative top section. Each panel may comprise at least one lacquer layer affixed, either directly or indirectly, to an upper surface of the decorative layer, preferably to an upper surface of the wear layer.

The lower side (rear side) of the core (layer(s)) may also constitute the lower side (rear side) of the panel as such. However, it is thinkable, and it may even be preferable, that the panel comprises a backing layer, either directly or indirectly, affixed to said lower said of the core. Typically, the backing layer acts as balancing layer in order to stabilize the shape, in particular the flatness, of the panel as such. Moreover, the backing layer typically contributes to the sound dampening properties of the panel as such. As the backing layer is typically a closed layer, the application of the backing layer to the lower side of the core will cover the core grooves at least partially, and preferably entirely. Here, the length of each core groove is preferably smaller than the length of said backing layer. The backing layer may be provided with cut-out portions, wherein at least a part of said cut-out portions overlap with at least one core groove. The at least one backing layer is preferably at least partially made of a flexible material, preferably an elastomer. The thickness of the backing layer typically varies from about 0.1 to 2.5 mm. Non-limiting examples of materials of which the backing layer can be at least partially composed are polyethylene, cork, polyurethane, polyvinylchloride, and ethylene-vinyl acetate. Optionally, the backing layer comprises one or more additives, such as fillers (like chalk), dyes, resins and/or one of more plasticizers. In a particular embodiment, the backing layer is at least partially made of a composite of ground (or shaved) cork particles bound by resin. Instead of cork other tree related products, such as wood, may be used. The thickness of a polyethylene backing layer is for example typically 2 mm or smaller. The backing layer may either be solid or foamed. A foamed backing layer may further improve the sound dampening properties. A solid backing layer may improve the desired balancing effect and stability of the panel.

In the panel according to the invention, it is preferred that the first and second side edges are opposing, parallel side edges.

In case the panel comprises a third and fourth side edge provided with a first and second profile, it is preferred that these are also opposing, parallel side edges.

However, it is also conceivable that the panel comprises a third edge provided with a third profile and a fourth edge provided with a fourth profile, wherein the third profile of said panel and the fourth profile of another panel are preferably arranged to be coupled by means of an angling down motion. Preferably, the third profile comprises: a sideward tongue extending in a direction substantially parallel to the upper side of the core, at least one second downward flank lying at a distance from the sideward tongue, and a second downward groove formed between the sideward tongue and the second downward flank. Preferably, the fourth profile comprises: a third groove configured for accommodating at least a part of the sideward tongue of the third coupling profile of an adjacent panel, said third groove being defined by an upper lip and a lower lip, wherein said lower lip is provided with an upward locking element. The third profile and the fourth profile are preferably configured such that two of such panels can be coupled to each other by means of a turning (angling down) movement, wherein, in coupled condition: at least a part of the sideward tongue of a first panel is inserted into the third groove of an adjacent, second panel, and wherein at least a part of the upward locking element of said second panel is inserted into the second downward groove of said first panel.

The panel according to the invention, is preferably of a rectangular, parallelogrammatic, or hexagonal shape. The panel preferably has an oblong shape.

It is further preferred that the panel according to the invention has a vertical thickness in the range of 3.0 mm to 20.0 mm, preferably in the range of 3.8 mm to 12.0 mm.

In a second aspect, the invention relates to a covering for a floor, ceiling or wall, which is constituted by a multitude of panels according to the first aspect of the invention, wherein said panels are coupled to each other by first profiles and second profiles that are interlocked with each other.

BRIEF DESCRIPTION OF THE DRAWINGS

The invention will be further elucidated with reference to preferred examples of the invention that are shown in the appended figures, wherein.

DESCRIPTION OF THE INVENTION

Figure 1:
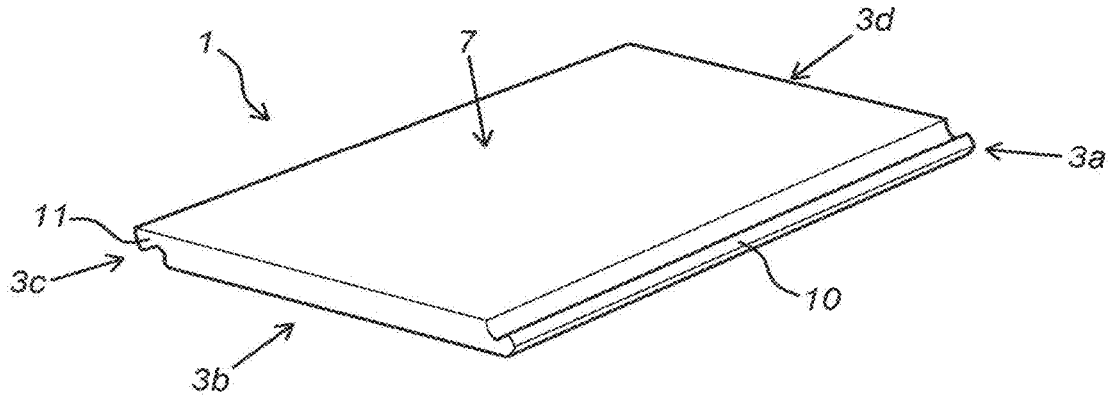
FIG. 1 shows in perspective a panel according to the invention.

FIG. 1 shows a panel 1 suitable as a floor, ceiling or wall panel, which panel is of a planar design having an upper side 7, a bottom side and side edges 3*a-d* which comprise a first side edge 3*a* provided with a first profile 10 and a second side edge 3*c* provided with a second profile 11.

Figure 2:
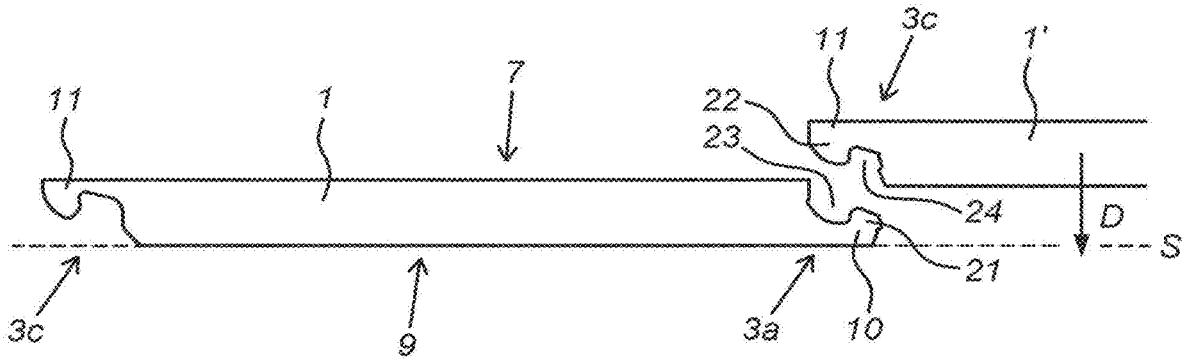
FIG. 2 shows a cross-sectional view of two panels according to the invention.

FIG. 2 shows a cross-section of the panel 1 of FIG. 1, perpendicular to the first and second side edges 3*a* and 3*c*, which are provided with a first profile 10 and a second profile 11. The bottom side 9 of the panel 1, is laid on a substrate layer for instance a floor surface S. Another identical panel 1' is shown in part, of which the second side edge 3*c* is to be coupled to the panel 1, by a downward vertical movement indicated by vector D.

The first profile 10 and the second profile 11 of both panels 1 and 1' are mutually interacting profiles that can be coupled to each other. During coupling, the second profile 11 of panel 1' is vertically inserted in the first profile 10 of panel 1, which involves the downward tongue 22 of panel 1' being inserted in the first groove 23 of panel 1, and the upward tongue 21 of panel 1 being inserted in the second groove 24 of panel 1'. When coupled, the panels 1 and 1' lie in a common plane which is parallel to the floor surface S.

Figure 3A:
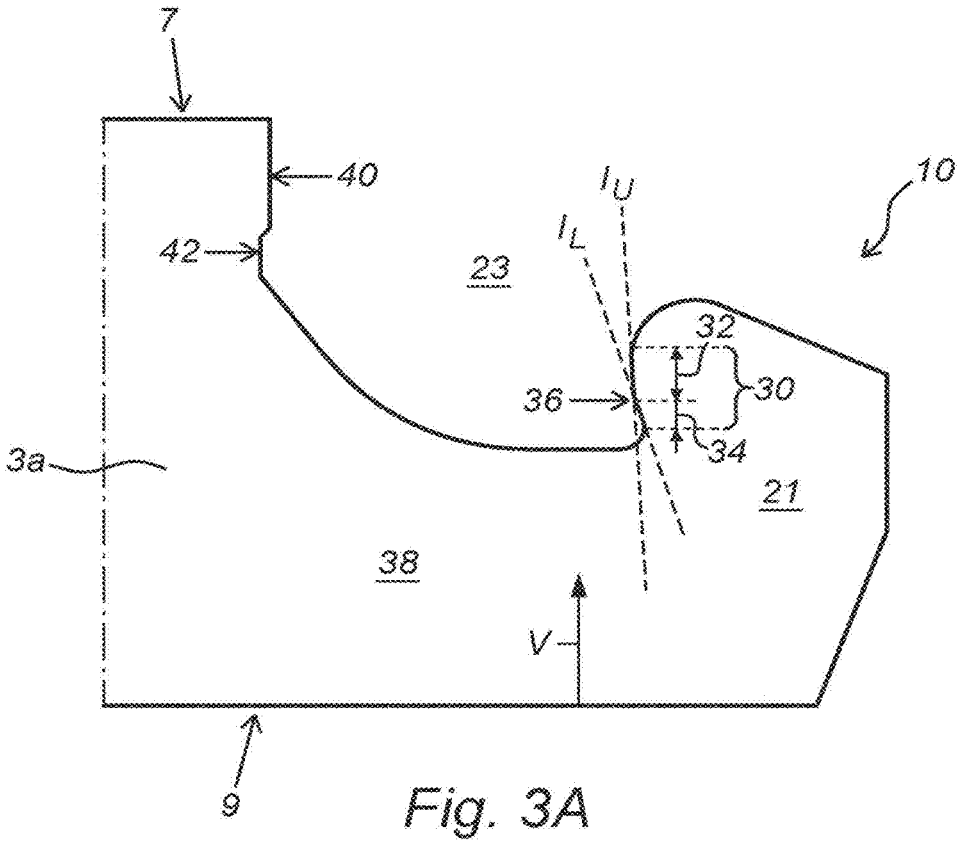
FIGS. 3A and 3B show in cross-section details of two interacting profiles according to the invention.
Figure 3B:
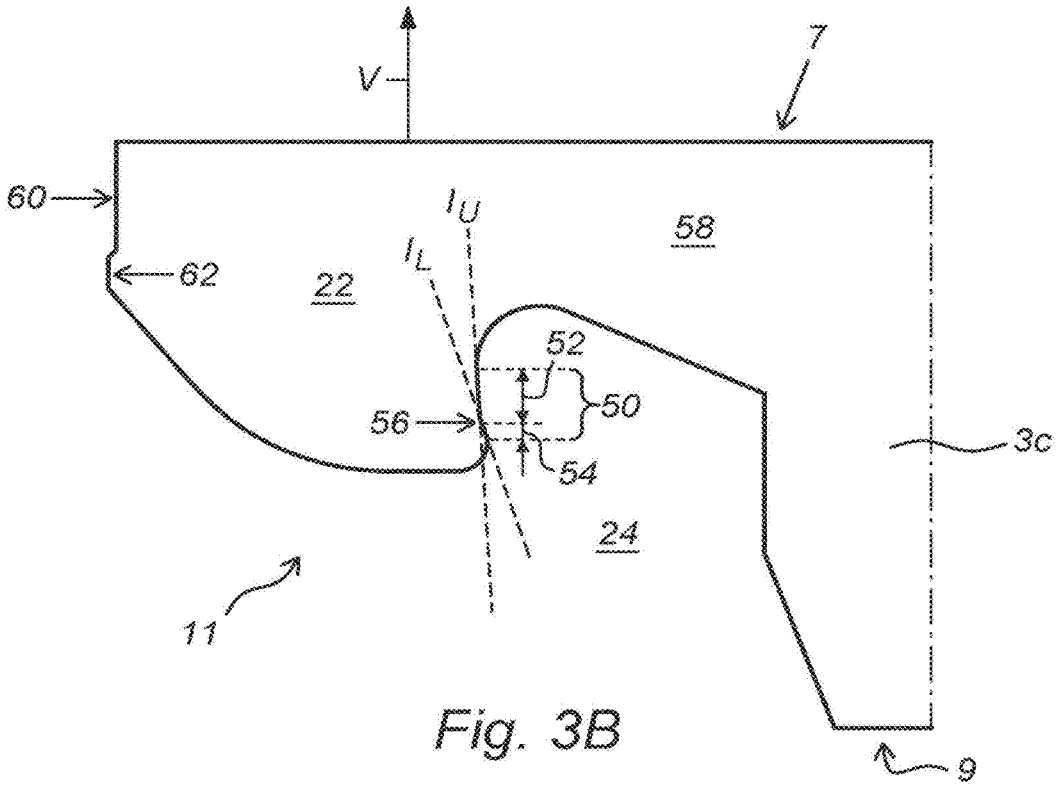

FIG. 3A and FIG. 3B respectively show in detail a preferred embodiment of the first profile 10 and second profile 11 provided at the first side edge 3*a* and the second side edge 3*c*, which are suitable for application in a panel shown in the preceding FIGS. 1 and 2. Features of the respective profiles 10 and 11 which correspond with the features shown in FIGS. 1 and 2, are indicated by the same reference numerals.

FIG. 3A, shows a first profile 10 wherein the upward tongue 21 is provided with an interlocking surface area 30, which is vertically divided in an upper area section 32 and a lower area section 34 that are adjacent to each other, and wherein a crease 36 is present as a joint between the upper area section and the lower area section.

Proximal to the crease 36, the upper area section 32 and the lower area section 34 are each inclined differently under according to inclination plane IU resp. IL. Relative to an upward vertical vector V of the panel, the inclination angle of the plane IU is about 1 to 3 degrees, and the inclination angle of the plane IL is about 6 to 10 degrees. At the intersection of the indicated inclination planes IU and IL, the crease is present which forms a cornered structure having an obtuse angle that results from the difference in angles of the inclination planes IU and IL, i.e. an obtuse angle of about 177 to 171 degrees. The upward tongue 21 has a rounded surface area above the upper area section 32, and a rounded surface area below the lower area section 34.

The upward tongue 21 is connected to the first side edge 3*a* by a lower bridge part 38 extending parallel to the plane of the panel at the bottom side 9 of the panel. An upper contact surface 40 the first side edge 3*a* extends substantially vertically towards the upper side of the panel, and is provided with an upper recess 42.

FIG. 3B, shows a second profile 11 wherein the downward tongue 22 has an interlocking surface area 50, which is vertically divided in an upper area section 52 and a lower area section 54 that are adjacent to each other, and wherein a crease 56 is present at the joint between the upper area section and the lower area section.

Proximal to the crease 56, the upper area section 52 and the lower area section 54 are each inclined differently according to inclination plane IU resp. IL. Relative to an upward vertical vector V of the panel, the inclination angle of the plane IU is about 1 to 3 degrees, and the inclination angle of the plane IL is about 6 to 10 degrees. At the intersection of the indicated inclination planes IU and IL, the crease 56 is present which forms a cornered structure having an obtuse angle that results from the difference in angles of the inclination planes IU and IL, i.e. an obtuse angle of about 177 to 171 degrees. The downward tongue 22 has a rounded surface area above the upper area section 52, and a rounded surface area below the lower area section 54.

The downward tongue 22 is connected to the second side edge 3*c* by an upper bridge part 58 extending parallel to the plane of the panel at the upper side 7 of the panel. An upper contact surface 60 of the second side edge 3*c* extends substantially vertically towards the upper side of the panel, and is provided with an upper protrusion 62.

Figure 4:
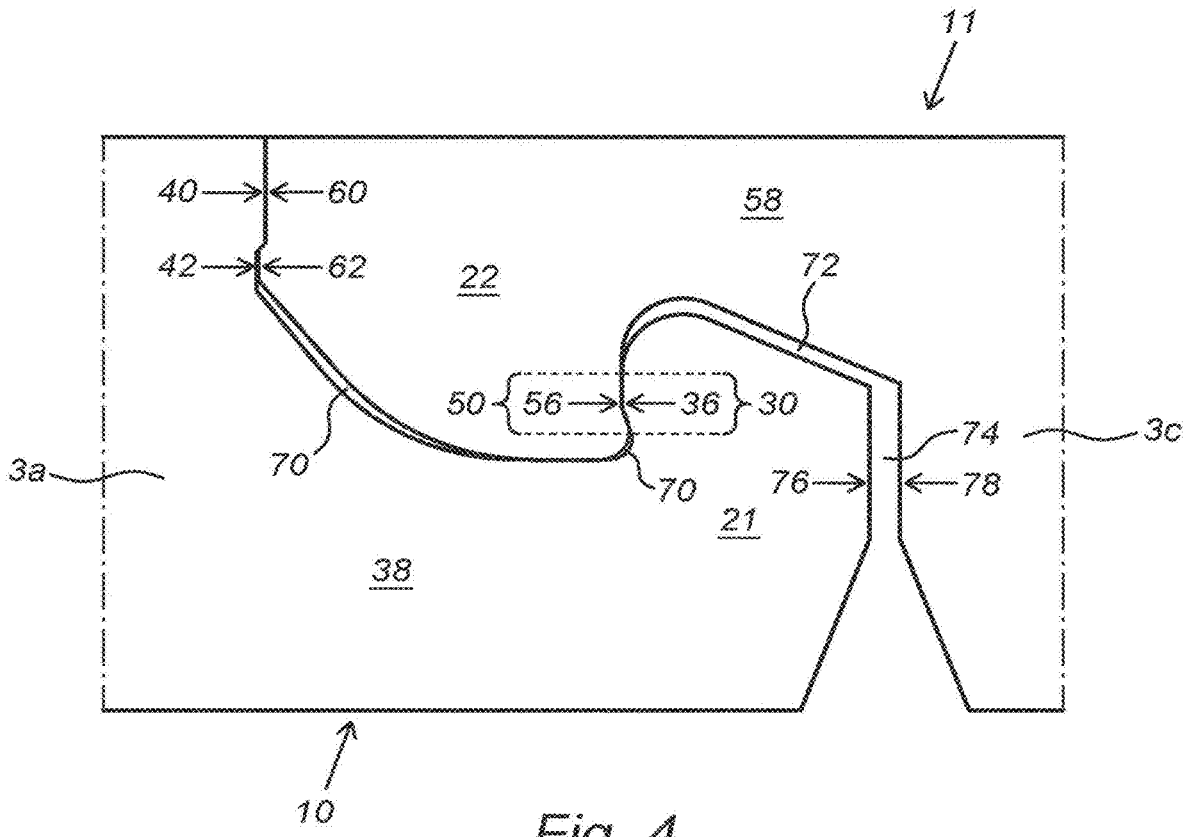
FIG. 4 shows the interacting profiles of FIGS. 3A and 3B in a coupled condition in a common plane.

FIG. 4 shows the profiles 10 and 11 of FIG. 3A resp. 3B, in a coupled condition wherein a horizontal and vertical locking is achieved. Herein, the respective contact surface areas 30 and 50 are facing each other in abutting contact, so that a horizontal and vertical locking of the two profiles is achieved. The creases 36 and 56 are also facing each other, thus forming an additional locking feature between the coupled profiles. At the same time, the upper contact surfaces 40 and 60 are in abutting contact, and the upper protrusion 62 and upper recess 42 are interlocked with each other.

As shown by FIG. 4, the two profiles are essentially complementary profiles, wherein it is allowed for that some parts of the facing surfaces of the two profiles are not in abutting contact when in coupled condition. Accordingly, interstitial spaces 70 are present between the downward tongue 22 and the lower bridge part 38, and an interstitial space 72 is present between the upward tongue 21 and the upper bridge part 58. Furthermore, a vertical interstitial space 74 is present between a frontal side 76 of the upward tongue 21 and a horizontally opposed side 78 of the second side edge 3*c*.

What is claimed is:

1. A panel suitable as a floor, ceiling or wall panel, which panel is of a planar design having an upper side, a bottom side and side edges which comprise a first side edge provided with a first profile and a second side edge provided with a second profile, wherein the first profile and the second profile are interacting profiles that can be coupled to each other, so that a first panel can be coupled in one common plane to a second, identical panel by the interacting profiles, wherein the first profile and the second profile in a coupled condition establish an interlocking with each other both in a horizontal direction and in a vertical direction, wherein the first profile and the second profile are configured to allow for a coupling of the interacting profiles of the first panel with the second panel by a downward insertion of the interacting profile of the second panel into the interacting profile of the first panel, and wherein the first profile comprises an upward tongue, and the second profile comprises a downward tongue, the respective tongues being configured to interlock with each other in a coupled condition by respective interlocking surface areas, wherein the interlocking surface area of the upward tongue is at least partially inclined upwardly towards the first side edge, and the interlocking surface area of the downward tongue is inclined upwardly away from the second side edge, wherein the interlocking surface areas of at least one of the upward tongue and the downward tongue, each comprises a section which is vertically divided in a plurality of area sections comprising an upper area section and at least one lower area section that are adjacent to each other, which section comprises a crease between the upper area section and the adjacent lower area section, wherein at least proximal to the crease, the upper area section and the adjacent lower area section are each inclined differently under an inclination angle which is measured relative to an upward vertical vector of the panel, such that the inclination angle of the upper area section is smaller than the inclination angle of the adjacent lower area section, wherein the inclination angle of the upper area section of the interlocking surface area of the upward tongue is in the range of 1 to 5 degrees, wherein the inclination angle of the upper area section of the interlocking surface area of the downward tongue is in the range of 1 to 5 degrees, and wherein a frontal side of the downward tongue of the second profile and a horizontally opposed side of the first edge comprise respective upper contact surfaces which extend substantially vertically towards the upper side of the panel and are configured to be in abutting contact when the first and second profile are in a coupled condition.

2. The panel according to claim 1, wherein the first profile and the second profile are essentially complementary profiles.

3. The panel according to claim 1, wherein the interlocking surface areas of the downward tongue and the upward tongue are configured to be facing each other when the first panel and the second panel are in a coupled condition.

4. The panel according to claim 1, wherein the crease of the upward tongue and the crease of the downward tongue extend linearly in the longitudinal direction of the respective side edges on which the creases are provided and extend in a horizontal plane of the panel.

5. The panel according to claim 1, wherein the entire interlocking surface area of the upward tongue is inclined upwardly towards the first side edge.

6. The panel according to claim 1, wherein the inclination angle of the lower area section of the interlocking surface area of the upward tongue, is in the range of 5 to 20 degrees and is similar or equal to the inclination angle of the lower area section of the interlocking surface area of the downward tongue.

7. The panel according to claim 1, wherein the crease defines a cornered structure between the upper area section and lower area section, which cornered structure when viewed in a vertical plane perpendicular to the respective side edge, has an obtuse angle in the range of 179 to 160 degrees, wherein the height of the cornered structure is less than 0.5 mm.

8. The panel according to claim 1, wherein the upper area section and the lower area section are essentially flat sections.

9. The panel according to claim 1, wherein the upward and downward tongue each have a rounded surface area above the upper area section, and a rounded surface area below the lower area section.

10. The panel according to claim 1, wherein at least one of the interlocking surface areas of the downward tongue and the upward tongue, is provided with a malleable coating.

11. The panel according to claim 10, wherein the lower area section of the downward tongue and/or the upper area section of the upward tongue, is provided with a wax coating.

12. The panel according to claim 1, wherein a frontal side of the downward tongue of the second profile is provided with at least one locking element and a horizontally opposed side of the first profile is provided with at least one counterlocking element, which said locking element and said counterlocking are substantially complementary, such that in a coupled condition of the two profiles, the locking element of the second profile interlocks with the counterlocking element of the first profile.

13. The panel according to claim 1, wherein:

the upward tongue is connected to the first side edge by a lower bridge part extending parallel to the plane of the panel at the bottom side of the panel, and wherein the lower bridge part delimits a downward groove which is enclosed between the upward tongue and the first side edge; and the downward tongue is connected to the second side edge by an upper bridge part extending parallel to the plane of the panel at a top side of the panel, and wherein the upper bridge part delimits an upward groove which is enclosed between the downward tongue and the second side edge;

further wherein the downward groove and the upward groove are configured to receive respectively the downward tongue and the upward tongue in a coupled condition of the two interacting profiles.

14. The panel according to claim 1, wherein an interstitial space is present between a frontal side of the upward tongue of the first profile and a horizontally opposed side of the second edge.

15. The panel according to claim 1, wherein an interstitial space is present which is enclosed by the downward tongue, the upward tongue, and a downward groove.

16. The panel according to claim 1, wherein the downward tongue comprises a convex, heel-shaped transition zone situated in between a bottom side and the interlocking surface area of the downward tongue.

17. The panel according to claim 1, wherein a downward groove comprises a concave, hollow-shaped transition zone situated in between a bottom side of the downward groove and the interlocking surface area of the upward tongue.

18. The panel according to claim 1, wherein a frontal side of the upward tongue of the first profile is provided with a lower protrusion and/or lower recess, and a horizontally opposed side of the second profile is provided with a lower recess and/or lower protrusion, wherein the protrusion and/or recess of the first profile and the recess and/or protrusion of the second profile are substantially complementary, such that in a coupled condition of two interacting profiles, the protrusion of the first profile and the recess of the second profile interlock with each other.

19. The panel according to claim 1, wherein the panel is a decorative panel, comprising:

at least one core layer, and at least one decorative top section, directly or indirectly affixed to said core layer, wherein the top section defines a top surface of the panel, a plurality of side edges at least partially defined by said core layer and/or by side top section, comprising said first side edge provided with said first profile and said second side edge provided with said second profile.

20. The panel according to claim 1, wherein the panel comprises a third edge provided with a third profile and a fourth edge provided with a fourth profile, wherein the third profile of said panel and the fourth profile of another panel are arranged to be coupled by means of an angling downward motion.

21. The panel according to claim 20, wherein the third profile comprises:

a sideward tongue extending in a direction substantially parallel to the upper side of the core, at least one second downward flank lying at a distance from the sideward tongue, and a second downward groove formed between the sideward tongue and the second downward flank, and wherein the fourth profile comprises:

a third groove configured for accommodating at least a part of the sideward tongue of the third coupling profile of an adjacent panel, said third groove being defined by an upper lip and a lower lip, wherein said lower lip is provided with an upward locking element, wherein the third profile and the fourth profile are configured such that two of such panels can be coupled to each other by means of a turning movement, wherein, in a coupled condition: at least a part of the sideward tongue of a first panel is inserted into the third groove of an adjacent, second panel, and wherein at least a part of the upward locking element of said second panel is inserted into the second downward groove of said first panel.

22. A covering for a floor, ceiling or wall, which is constituted by a multitude of panels according to claim 1, which panels are coupled to each other by first profiles and second profiles that are interlocked with each other.

* * * * *